US005927797A

United States Patent [19]

Ferguson

[11] Patent Number: 5,927,797

[45] Date of Patent: Jul. 27, 1999

[54] PORTABLE WORK STOOL

[76] Inventor: Bobby J. Ferguson, 5530 N. Estrella, Eloy, Ariz. 85231

[21] Appl. No.: 09/130,016

[22] Filed: Aug. 6, 1998

[51] Int. Cl.[6] ..... A47C 1/00

[52] U.S. Cl. ..... 297/4

[58] Field of Search ..... 297/4, 313, 337, 297/338, 339; 248/125.8, 161, 157

[56] References Cited

U.S. PATENT DOCUMENTS

| | | |
|---|---|---|
| 226,252 | 4/1880 | Smith et al. . |
| 406,328 | 7/1889 | Yagn . |
| 466,618 | 1/1892 | McDonald . |
| 533,604 | 2/1895 | McHugh . |
| 671,638 | 4/1901 | Slagle . |
| 699,932 | 5/1902 | Smith . |
| 759,809 | 5/1904 | Farley . |
| 1,709,200 | 4/1929 | Westbrook et al. . |
| 2,099,345 | 11/1937 | Olszanowski . |
| 4,232,896 | 11/1980 | Caldwell . |
| 4,641,882 | 2/1987 | Young . |

*Primary Examiner*—Milton Nelson, Jr.
*Attorney, Agent, or Firm*—John D. Lister

[57] ABSTRACT

A portable work stool includes a seat that is secured to and carried by the user adjacent the user's posterior when standing and moving about and a single variable length support leg supporting the seat. The support leg can be adjusted to and maintained at a selected length so that the seat is a selected height above the ground, desired by the user, when a normal crouching or seated weight is exerted on the seat by the user. The support leg also includes a device, such as spring loaded telescoping sections, for maintaining a lower end of the support leg in contact with the ground at a selected location when there is an upward or downward movement of the seat from the selected height caused by an upward or downward movement of the user so that the portable stool remains properly positioned beneath the user during such upward and downward movements.

12 Claims, 2 Drawing Sheets

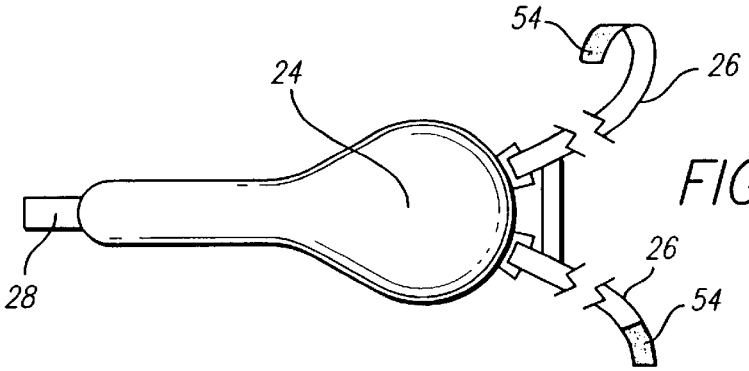
FIG. 3
FIG. 2
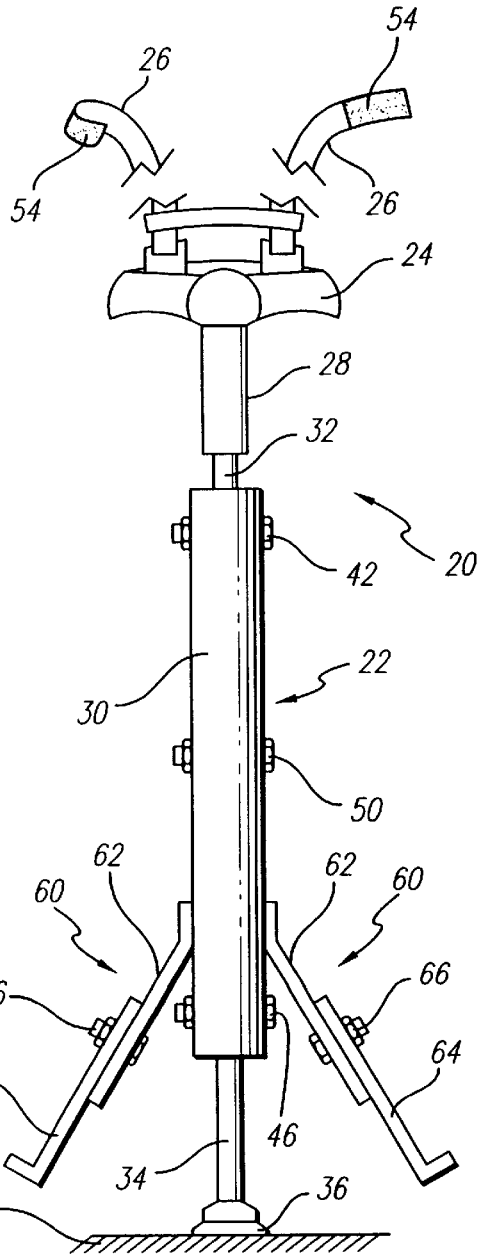
FIG. 1
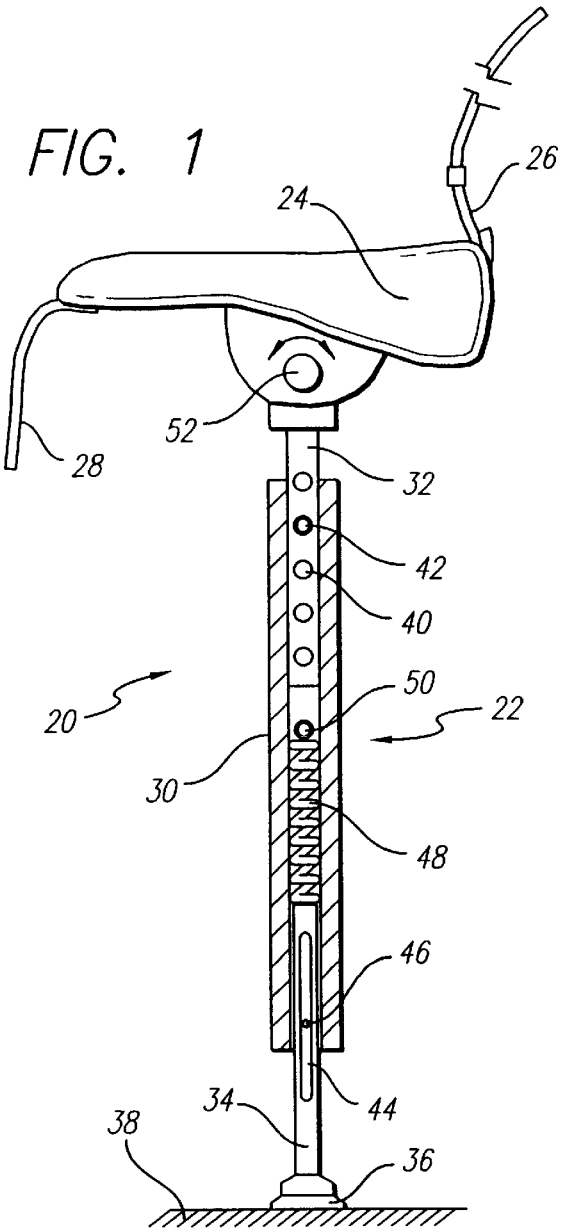

FIG. 6
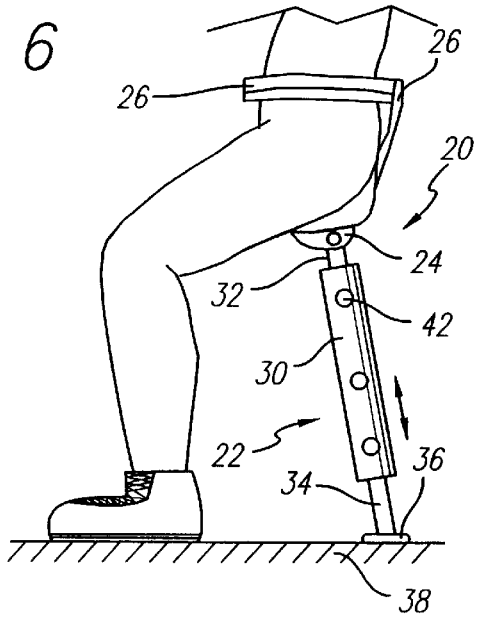
FIG. 4
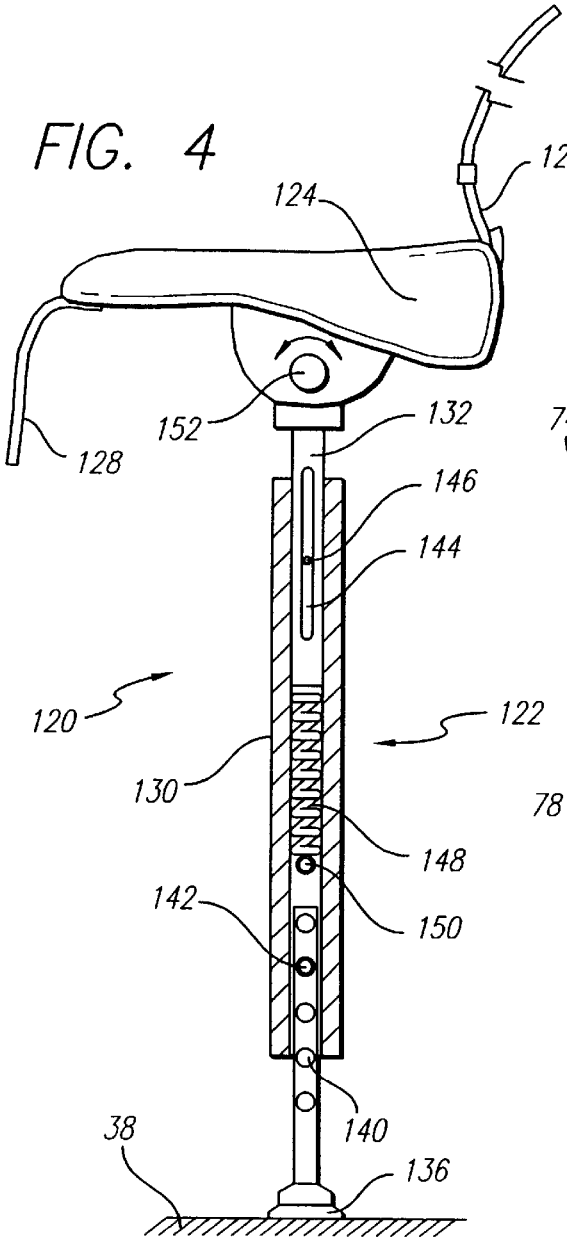
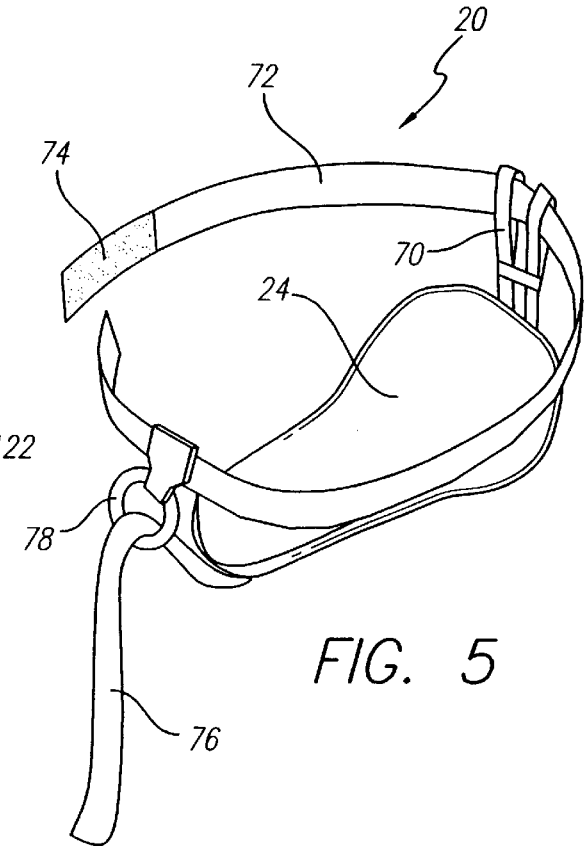
FIG. 5

PORTABLE WORK STOOL

BACKGROUND OF THE INVENTION

The present invention relates to a portable work stool and, in particular, to a portable work stool for use by farriers and the like which is secured to the user and has a single leg that maintains contact with the ground at a selected location while supporting the user even when the user moves or is jostled, e.g. by the movement of a horse or other animal. While the work stool of the present invention is especially suited for use by farriers, the work stool is also suitable for tasks such as but not limited to, field work, milking, working on vehicles and other tasks where the user crouches or sits to perform the task. As used herein, the term "crouch" means a position assumed by a person wherein his/her legs are bent at the knees, (as shown in FIG. 6) with the front of the leg above the knee at an angle to the vertical of less than 90° or substantially 90° as would be the case if the person were sitting.

Currently, when shoeing a horse or other animal, the farrier typically crouches with no support and grips the lower portion of the horse's or animal's leg between his legs to work on the horse's or animal's hoof. Shoeing a horse typically takes about one hour and this places a great deal of stress and strain on the lower back and legs of the farrier which is made worse by frequent movements of the animal. The stress and strain placed on the farrier lower back and legs while crouching to perform the task reduces the amount of time the farrier can spend working on an animal or animals without taking a rest; reduces the total time the farrier can work on any given day due to the overall stress and strain placed on the farrier; and otherwise reduces the efficiency of the farrier and increases labor costs. In addition, the amount stress and strain placed on a farrier while performing such work prohibits certain persons with back or leg problems from working in this field.

Portable stools have been made in the past in an attempt to resolve the above and other problems. Examples of such attempts are disclosed in the following patents. U.S. Pat. No. 226,252, issued Apr. 6, 1880 discloses an adjustable stool which is strapped to the operator. U.S. Pat. No. 466,618, issued Jan. 5, 1892, discloses a combined horseshoer's stool and clincher. U.S. Pat. No. 533,604, issued Feb. 5, 1895, discloses a farrier's shoe stand. U.S. Pat. No. 671,638, issued Apr. 9, 1901, discloses a stool and cane that is strapped to the user. U.S. Pat. No. 699,932, issued May 13, 1902, discloses a portable seat which is strapped to the user. U.S. Pat. No. 759,809, issued May 10, 1904 discloses a cotton, berry or vegetable picking or dairy stool which is strapped to the user. U.S. Pat. No. 1,709,200, issued Apr. 16, 1929, discloses a sanitary milking rest which is strapped to the user and has a pointed lower end that engages the floor or ground to keep the rest from moving. While the stools and other devices disclosed in the above patents are useful, none of the stools or other devices disclosed provide a means for maintaining the lower end of the support leg properly positioned beneath the user and in contact with the ground to provide support for the user in the event the user is raised up or moved, e.g. by a horse or other animal, or raises up of his/her own accord to reach for something or for some other reason.

SUMMARY OF THE INVENTION

The present invention provides a solution to the above problem by providing a portable work stool for supporting the user while performing tasks: a) where the user normally crouches or sits to perform the task; b) where the user needs to have his/her hands free while performing the task and moving about, such as when shoeing a horse where the farrier should have his/her hands free while working with the horse and moving back and forth between the horse and an anvil; and c) where the user is apt to be moved about while performing the task, such as by movement of the horse during the shoeing process, and still needs to be supported by the stool or where the user needs to move about while performing the task and still be supported by the stool.

In a preferred embodiment of the portable work stool of the present invention, the portable work stool includes a telescoping support leg, a seat mounted on the support leg, straps at the back of the seat for strapping the seat to the waist of the user, and a front strap for locating the seat between the legs of the user at the user's crotch for crouching or sitting and bringing the lower end of the support leg in contact with the ground or floor at the desired location. The telescoping support leg in the preferred embodiment has a spring loaded lower or upper extension or section which slides up and down with respect to a midsection of the support leg. When the user, e.g. a farrier, is crouching or sitting on the portable work stool and using the portable work stool for support, the spring loaded lower or upper extension or section maintains the lower end of the telescoping support leg in contact with the ground and properly positioned beneath the user to support the user even when the user rises up or is raised up, such as when a horse raises up or otherwise moves the farrier, or when the user places more weight on the portable work stool or is forced down, e.g. by the movement of a horse. Since the portable work stool is strapped to the user, about the user's waist, the user is free to move about with the portable work stool while having his/her hands free, and prior to sitting down on the portable work stool, the user merely needs to move the seat of the stool into position by using the front strap mounted on the seat. Thus, the portable work stool of the present invention, provides the support required to alleviate stress and strain on the lower back and legs of farriers and other workers who need to have their hands free, move about, and may have to move or are moved while crouching or sitting on the stool for support to perform their task.

Preferably, the seat of the portable work stool is narrow which enables the a farrier to better grip a horse's leg between his legs to work on the hoof; the length of the telescoping support leg is adjustable to set the seat height at a comfortable level for the user when crouching or sitting; and a pair of stabilizing legs can be secured to the telescoping support leg to prevent the portable work stool from tipping sideways.

BRIEF DESCRIPTION OF THE DRAWINGS

FIG. 1 is a side elevation of a first embodiment of the portable work stool of the present invention with the lower spring loaded section or extension of the telescoping support leg only partially extended from the midsection of the support leg.

FIG. 2 is a front elevation of the portable work stool of FIG. 1 with the lower spring loaded section or extension of the support leg partially extended from the midsection of the support leg.

FIG. 3 is a top view of the seat of the portable work stool of FIG. 1 with the straps for securing the portable work stool to the user.

FIG. 4 is a side elevation of a second embodiment of the portable work stool of the present invention with the upper spring loaded section or extension of the telescoping support leg only partially extended from the midsection of the support leg.

FIG. 5 is a perspective view of an alternative embodiment of the seat and straps for securing the portable work stool to the user.

FIG. 6 is a schematic representation of a person in a crouch, such as when horse shoeing, and using the portable work stool of the present invention as a support.

DESCRIPTION OF THE PREFERRED EMBODIMENTS

FIGS. 1–3 show a first embodiment 20 of the portable work stool of the present invention which includes a variable length, telescoping support leg 22, a seat 24 mounted on the support leg, straps 26 at the back of the seat 24 for strapping the seat to the waist of the user, and a front strap 28 for locating the seat between the legs of the user at the user's crotch and the lower end of the support leg 22 in contact with the ground at the proper location prior to crouching or sitting on the portable work stool for support. Preferably, the tubular and cylindrical components of the telescoping support leg are made of a metal, such as steel, or a polymeric or reinforced polymeric material.

When the portable work stool is used for horse shoeing, the length of portable work stool from the upper surface of the seat 24 to the lower end 36 of the portable work stool, with the telescoping support leg fully extended, can typically be adjusted from about twenty nine to about thirty six inches. For performing other tasks where the user would normally be in more of a sitting position or a sitting position rather than crouching, the maximum and minimum length of the portable work stool, over which it can be adjusted, will typically be less, such as but not limited to about twenty six to about twenty inches. As will be discussed more fully hereinafter, when the user places his/her weight on the portable work stool 20 for support, the spring loaded extension or section of the telescoping support leg will be depressed within the midsection of the telescoping leg 22 and the overall length of the portable work stool will typically shorten by two to five inches.

As shown in FIGS. 1 and 2, telescoping support leg 22 of the portable work stool 20 includes a midsection 30, an upper section or extension 32 on which the seat 24 is mounted, and a lower spring loaded section or extension 34 for keeping the lower end 36 of the telescoping support leg 22 in contact with the ground or floor 38 when there is upward and/or downward movement of the user while crouching or seated on the portable work stool. As best shown in FIG. 1, the upper section 32 is slidably received within an upper portion of the midsection 30 of the telescoping support leg 22 and has a series of horizontally extending holes 40 therein for receiving a pin or bolt 42 that passes through both the upper portion of the midsection 30 and one of the holes 40 in the upper section 32 to set the height of the seat 24 above the ground 38 to a selected height desired by the user for crouching or sitting on the portable work stool 20. As discussed above, when used for horse shoeing, preferably, the upper section 32 enables the height of the seat to be adjusted in increments of about one inch for about six inches with the overall height of the portable work stool 20, with the lower section or extension 34 fully extended, preferably being between about twenty nine and about thirty six inches.

The lower section or extension 34 is slidably received within a lower portion of the midsection 30 of the telescoping support leg 22 and has an elongated slot 44 (preferably, from about three inches to about nine inches long and most preferably from about four to about seven inches long) therein for receiving a pin or bolt 46 that passes through both the lower portion of the midsection 30 and the lower section or extension 34. As shown a coil spring 48 is located within the midsection 30 intermediate a pin, bolt or other means 50 to block the upward movement of the coil spring 48 and the upper end of the lower section or extension 34. In an unweighted condition (when no one is crouching or sitting on the portable work stool 20 for support), the coil spring 48 forces or urges the lower section or extension 34 of the telescoping support leg 22 to a fully extended position wherein the pin or bolt 46 passing through the both the lower portion of the midsection 30 and the lower section or extension 34 abuts the upper end of the elongated slot 44. In a normal weighted condition (when the user, e.g. a farrier, is crouching or sitting on the portable work stool at rest for support) the lower section or extension 34 will only be partially extended in a position such as that shown in FIGS. 1, 2 and 6, where the location of the pin or bolt 46, relative to the elongated slot 44, is intermediate the upper and lower ends of the slot and preferably about one third or less of the length of the slot (e.g. two inches or less) from the lower end of the elongated slot 44. In a fully weighted condition, such as when the user is forced downward by the movement of horse, the downward force of the coil spring 48 on the upper end of the lower section or extension 34 of the telescoping support leg 22 or the contact of the pin or bolt 46 passing through the both the lower portion of the midsection 30 and the elongated slot 44 in lower section or extension 34 with the lower end of the elongated slot 44 limits the downward movement of the portable work stool 20 from its normal weighted position.

The coil spring 48 is selected to support the weight of an adult, e.g. a person weighing between about 105 and 245 pounds, so that the force from the weight of the person crouching or seated at rest on the seat 24 will preferably compress the spring 48, from an uncompressed length of about four to about ten inches to a partially compressed length of between about two inches and about seven inches, and thus move the lower section or extension 34 axially up into the midsection 30 a distance of about two inches to about eight inches. While three inches of vertical movement in the telescoping support leg 22 has been found sufficient to keep the lower end 36 of the telescoping support leg in contact with the ground or floor 38 for many vertical movements experienced when the portable work stool 20 is being used by a farrier for shoeing horses, the preferred range of four to seven inches assures that the lower end 36 of the telescoping support leg 22 remains in contact with the ground for all but the most excessive movements of the horse. While the elongated slot 44 can be longer than nine inches and the spring longer than ten inches, for practical purposes nine inches of vertical movement is sufficient. If the horse is moving the farrier vertically for more than nine inches, the horse is most likely out of control and the farrier had better move away from the horse. Preferably, the weight of the person crouching or sitting at rest on the seat 24 will not fully compress the coil spring 48 so that downward movement of the portable work stool will be resisted by further compression of the spring 48 to cushion the user should the user be forced downward, e.g by the movement of a horse.

Preferably, the seat 24 of the portable work stool 20 is a narrow seat, such as a narrow bicycle seat, which is secured to the upper end of the upper section 32 of the telescoping support leg 22 by a bolt mount 52 that permits the seat 24 to be adjusted about a horizontal axis, such as a conventional mount used to secure a bicycle seat to the upstanding support shaft mounted in the bicycle frame. The seat 24 is provided with a pair of straps 26 secured to the back of the seat 24 (either permanently or with a conventional quick connect/disconnect coupling). The straps pass around and are secured to the waist of the user so that the seat of the portable work stool is carried by the user below the waist of the user and adjacent the user's posterior or buttocks when the user is standing and moving about. The straps can be provided with a hook and loop or hook and pile securement means 54, such as Velcro™, a belt buckle, or other conventional means for securing the ends of the straps together about the waist of the user.

The seat 24 is also provided with a strap 28, mounted on the front end of the seat, to gripped by the user to facilitate swinging the seat 24 of the portable work stool 20 from the position adjacent the use's posterior or buttocks when the user is up and moving around to a position between the upper portions of the user's legs at the user's crotch when the user is ready to crouch or sit on the portable work stool 20 for support. As the seat is swung up into the crouch area, the lower end 36 of the support leg is brought into contact with the ground and properly positioned beneath the user for support.

As shown in FIG. 2, the portable work stool 20 can also be provided with a pair of side stabilizers 60 to prevent the portable work stool from tipping to far over sideways. The side stabilizers 60 extend diagonally out from each side of the telescoping support leg 22 and, as shown, can be welded or otherwise permanently secured to the sides of the midsection 30 of the telescoping support leg 22. As shown, each of the side stabilizers includes upper and lower sections 62 and 64 which are bolted together. Either or both of the sections have an elongated slot therein through which the bolt 66 passes so that the length of the side stabilizers can be adjusted to a selected length so that preferably, the side stabilizers are not in contact with the ground when the user is crouching or sitting on the portable work stool at rest (a normal weighted condition). While not shown, the upper ends of the side stabilizers can be bolted to the sides of the midsection 30, e.g. with the bolt 50, so that the side stabilizers can be removed from the portable work stool if desired. In addition, when bolted to the midsection by bolt 50, the upper ends of the side stabilizers 60 could be elongated and slotted to permit vertical adjustment of the side stabilizers rather than making the adjustment by having upper and lower sections 62 and 64 bolted together and the side stabilizers could each be made of one piece.

FIG. 4 shows a second embodiment 120 of the portable work stool of the present invention which includes a telescoping support leg 122, a seat 124 mounted on the support leg, straps 126 at the back of the seat 124 for strapping the seat to the waist of the user, and a front strap 128 for locating the seat between the legs of the user at the user's crotch and properly locating the lower end of the support leg on the ground or floor prior to crouching or sitting on the portable support stool for support.

As shown in FIG. 4, telescoping support leg 122 of the portable work stool 120 includes a midsection 130, an upper spring loaded section 132 to which the seat 124 is mounted, and a lower section or extension 134. The upper spring loaded section 132 keeps the lower end 136 of the telescoping support leg 122 in contact with the ground or floor 38 when there is upward and/or downward movement of the user while crouching or seated on the portable work stool. The upper section 132 is slidably received within an upper portion of the midsection 130 of the telescoping support leg 122 and has an elongated slot 144 (preferably, from about three inches to about nine inches long and most preferably from about four to about seven inches long) therein for receiving a pin or bolt 146 that passes through both the upper portion of the midsection 130 and the upper section or extension 132. As shown a coil spring 148 is located within the midsection 30 intermediate a pin, bolt or other means 150 to block the downward movement of the coil spring 148 and the lower end of the upper section or extension 132. In an unweighted condition (when no one is crouching or sitting on the portable work stool 120), the coil spring 148 forces or urges the upper section or extension 132 of the telescoping support leg 122 to a fully extended position wherein the pin or bolt 146 passing through the both the upper portion of the midsection 130 and the upper section or extension 132 abuts the lower end of the elongated slot 144. In normal weighted condition, when the user, e.g. a farrier, is crouching or sitting on the portable work stool at rest, the upper section or extension 132 will only be partially extended in a position such as that shown in FIG. 4, where the location of the pin or bolt 146, relative to the elongated slot 144, is intermediate the upper and lower ends of the slot and preferably about one third or less of the length of the slot (e.g. two inches or less) from the upper end of the elongated slot 144. In a fully weighted condition, the upward force of the coil spring 148 on the lower end of the upper section or extension 132 of the telescoping support leg 122 or the contact of the pin or bolt 146 passing through the both the upper portion of the midsection 130 and the elongated slot 144 in upper section or extension 132 with the upper end of the elongated slot 144 limits the downward movement of the portable work stool 120.

The coil spring 148 is selected to support the weight of an adult, e.g. a person weighing between about 105 and 245 pounds, so that the force from the weight of the person crouching or seated at rest on the seat 124 will preferably compress the spring 148, from an uncompressed length of about four to about ten inches to a partially compressed length of between about two inches and about seven inches, and thus move the upper section or extension 132 axially down into the midsection 130 a distance of about two inches to about eight inches. While three inches of vertical movement has been found sufficient to keep the lower end 136 of the telescoping support leg in contact with the ground or floor 38 for many vertical movements experienced when the portable work stool 120 is being used by a farrier for shoeing horses, the preferred range of four to seven inches assures that the lower end 136 of the telescoping support leg 122 remains in contact with the ground for all but the most excessive movements of the horse. While the elongated slot 144 can be longer than nine inches and the spring 148 longer than ten inches, for practical purposes nine inches of vertical movement is sufficient. If the horse is moving the farrier vertically for more than nine inches, the horse is most likely out of control and the farrier had better move away from the horse. Preferably, the weight of the person crouching or sitting at rest on the seat 124 will not fully compress the coil spring 148 so that downward movement of the portable work stool will be resisted by further compression of the spring 148 to cushion the user should the user be forced downward, e.g by the movement of a horse.

The lower section or extension 134 is slidably received within a lower portion of the midsection 130 of the telescoping support leg 122 and has a series of horizontally extending holes 140 therein for receiving a pin or bolt 142 that passes through both the lower portion of the midsection 130 and one of the holes 140 in the lower section 132 to set the height of the seat 124 above the ground 138 to a selected height desired by the user for crouching or sitting on the portable work stool 120. Preferably, the lower section 134 enables the height of the seat to be adjusted in increments of about one inch for about six inches. When used for horse shoeing, preferably, the overall height of the portable work stool 120 with the upper section or extension 132 fully extended, is between about twenty nine and about thirty six inches.

As with the first embodiment, preferably, the seat 124 of the portable work stool 120 is a narrow seat, such as a narrow bicycle seat, which is secured to the upper end of the upper section 132 of the telescoping support leg 122 by a bolt mount 152 that permits the seat 124 to be adjusted about a horizontal axis, such as a conventional mount used to secure a bicycle seat to the upstanding support shaft mounted in the bicycle frame. The seat 124 is provided with a pair of straps 126 secured to the back of the seat (either permanently or with a conventional quick connect/disconnect coupling). The straps pass around and are secured to the waist of the user so that the seat of the portable work stool 120 is carried by the user below the waist of the user and adjacent the user's posterior or buttocks when the user is standing and moving about. The straps can be provided with a hook and loop or hook and pile securement means 54, such as Velcro™, a belt buckle, or other conventional means for securing the ends of the straps together about the waist of the user.

The seat 124 is also provided with a strap 128, mounted on the front end of the seat, to gripped by the user to facilitate swinging the seat 124 of the portable work stool 120 from the position adjacent the use's posterior when the user is up and moving around to a position between the upper legs of the user at the user's crotch when the user is ready to sit on the portable work stool 120. As the seat 124 is swung up into the crouch area, the lower end 136 of the support leg is brought into contact with the ground and properly positioned beneath the user for support.

While not shown, the portable work stool 120 can also be provided with side stabilizers such as the side stabilizers shown in FIG. 2 and described above in connection with the portable work stool 20.

FIG. 5 shows another strap arrangement for securing the portable work stool 20 or 120 about the waist of the user. As shown, the seat 24 or 124 is provided with a pair of straps 70 mounted on and extending up from the rear of the seat (either permanently or with a conventional quick connect/disconnect coupling). The straps 70 each have a loop at the upper end through which a strap or belt 72 passes. The free ends of the strap or belt 72 are provided with a hook and loop or hook and pile securement means 54, such as Velcro™, a belt buckle or similar means 74 for securing the strap about the waist of the user so that the portable work stool is carried by the user below the waist of the user and adjacent the user's posterior or buttocks when the user is standing and moving about. The seat 24 or 124 is also provided with a strap 76, mounted on the front end of the seat, to be gripped by the user to facilitate swinging the seat 24 or 124 of the portable work stool from the position adjacent the use's posterior or buttocks when the user is up and moving around to a position between the upper portions of the user's legs at the user's crotch when the user is ready to crouch or sit on the portable work stool. As the seat is swung up into the crouch area, the lower end of the support leg is brought into contact with the ground and properly positioned beneath the user for support. The strap 76 passes through a ring 78 at the front of the strap or belt 72 so that the strap 76 is readily accessible to the user.

In use a person desiring to use the portable work stool 20 or 120 crouches or sits on the seat 24 or 124 of the portable work stool at rest (a normal weighted condition for that user). If the portable work stool is not at the height desired for the user, the person adjusts the height of the portable work stool by adjusting the upper section or extension 32 in the portable work stool 20 or by adjusting the lower section or extension 134 in the portable work stool 120. Once the height of the portable work stool is adjusted to the selected height, the user adjusts the angle of seat for his/her comfort and straps the portable work stool on about his/her waist so that the seat of the portable work stool is carried by the user below the waist of the user and adjacent the user's posterior or buttocks when the user is standing and moving about. When the user is ready to crouch or sit on the portable work stool to commence work, e.g. shoeing a horse, the user grasps the front strap 28, 128 or 76 and moves the seat 24 or 124 of the portable work stool from the position adjacent the use's posterior or buttocks when the user is up and moving around to a position between the upper portions of the user's legs at the user's crotch. Holding onto the strap, the user then: selects the proper location on the ground or floor 38 to place the lower end 36 or 136 of the telescoping support leg 22 or 122 to give the user the required support; places the lower end of the telescoping support leg 22 or 122 at that location; crouches (as shown in FIG. 6) or sits on the portable work stool 20 or 120; and commences work crouching or seated at his/her desired height for the task. If the task, such as horse shoeing, causes upward and downward movement of the user relative to the set or normal height of the portable work stool, such as when a horse moves, for upward movement, the spring loaded lower or upper extension keeps the lower end 36 or 136 of the telescoping support leg 22 or 122 in contact with the ground or floor 38 at the selected location to maintain support for the user and, for downward movement, the spring loaded upper or lower extension cushions the downward movement of the portable work stool for the comfort of the user. Any time the user needs to move about, the user merely stands up and goes about his/her task with the portable work stool strapped about his/her waist and ready to be moved into position the next time the user crouches or sits down.

While the embodiments shown have upper and lower cylindrical extensions or sections of the telescoping support leg received within a tubular midsection, the upper and lower extensions or section can be tubular and the midsection can be a solid cylindrical midsection. Preferably, a conventional coil spring or its equivalent is used to extend the upper or lower section of the portable work stool.

A third stabilizer arm (not shown) could also be placed at the rear of the portable support stool. However, since the telescoping support leg 22 of the portable work stool is typically inclined forward from the ground or floor at an angle when located beneath the user for support, e.g. as shown in FIG. 6, the length of a third stabilizer arm, required to prevent backward tilting movement of the portable work stool might interfere with the placement of the portable work stool in confined quarters or otherwise present problems when the user is up and moving around.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A portable work stool, comprising:

a seat means for supporting a person in a crouching or sitting position when the seat means is positioned at the person's crotch; means for securing the seat means to the person so that the seat means is moveable from a first position where the seat means of the portable work stool is carried by the person adjacent the person's posterior when the person is standing and moving about to a second position at the person's crotch for crouching or sitting;

only a single telescoping support leg means for supporting the seat means; the support leg means including means at an upper end of the support leg means securing the support leg means to the seat means; the support leg means having a variable length; the support leg means having means for adjusting the length of the support leg means to a selected length, under a normal weighted condition when the person is crouching or seated at rest on the seat means, to thereby adjust the seat means to a selected height above the ground desired by the person and for maintaining the seat means at the selected height under the normal weighted condition; and the support leg means having a lower end free of attachment to the person's lower extremities; the support leg means having means, when the person is crouching or seated on the seat means, for maintaining the lower end of the support leg means in contact with the ground at a selected location when there is an upward movement of the seat means from the selected height caused by an upward movement of the person so that the portable work stool remains properly positioned beneath the person during such upward movements; and means for moving the seat means from the first position to the second position where the seat means is positioned between the upper portions of the person's legs at the person's crotch for crouching or sitting and for bringing the lower free end of the telescoping support leg into position for contact with the ground prior to crouching or sitting on the seat means.

2. The portable work stool according to claim 1 wherein: the means for bringing the seat means from the first position to the second position between the upper portions of the person's legs at the person's crotch is a strap secured to the front portion of the seat means; and the means for securing the seat means to the person has a belt for securing the seat means about the person's waist and straps connecting a rear portion of the seat means to the belt.

3. The portable work stool according to claim 1, wherein: the means for securing the seat means to the person is a belt means for securing the seat means about the person's waist.

4. The portable work stool according to claim 1 wherein: the means for bringing the seat means from the first position to the second position between the upper portions of the person's legs at the person's crotch is a strap secured to the front portion of the seat means; the means for securing the seat means to the person has a belt for securing the seat means about the person's waist and straps connecting a rear portion of the seat means to the belt; and the belt is provided with loop means at a front portion of the belt for receiving the strap secured to the front portion of the seat means.

5. The portable work stool according to claim 1, including: side stabilizer means secured to the support leg means for limiting sideward tilting movement of the portable work stool.

6. The portable work stool according to claim 5, wherein: the side stabilizer means includes two stabilizer arms secured to and projecting outwardly and downwardly from the support leg; the two stabilizer arms having lower ends for contacting the ground when there is sideward tilting movement of the portable work stool; and means for vertically adjusting the positions of the lower ends of the stabilizer arms relative to the support leg.

7. The portable work stool according to claim 1, wherein: the means for maintaining the lower end of the support leg means in contact with the ground comprises first and second telescoping sections of the support leg means, and a spring means for urging the second section axially away from the first section to elongate the support leg means from the selected length when there is less than the normal weighted condition caused by upward movement of the person.

8. The portable work stool according to claim 7, wherein: the spring means for urging the second section axially away from the first section allows the support leg means to shorten in length from the selected length when there is more than the normal weighted condition caused by downward movement of the person.

9. The portable work stool according to claim 8, wherein: the first and second telescoping sections of the support leg means are located in a lower portion of the support leg means.

10. The portable work stool according to claim 8, wherein: the first and second telescoping sections of the support leg means are located in an upper portion of the support leg means.

11. The portable work stool according to claim 8, including: side stabilizer means secured to the support leg means for limiting sideward tilting movement of the portable work stool.

12. The portable work stool according to claim 8, wherein: the means for securing the seat means to the person is a belt means for securing the seat means about the person's waist.

* * * * *